United States Patent [19]

Schoelkopf

[11] 4,129,398

[45] Dec. 12, 1978

[54] METHOD AND APPARATUS FOR PLASTIFYING AND TEARING UP OF DAMAGED ROAD-SURFACES AND COVERS

[76] Inventor: Walter Schoelkopf, Bruehlstrasse 38, 7024 Filderlinden, Fed. Rep. of Germany

[21] Appl. No.: 745,122

[22] Filed: Nov. 26, 1976

[30] Foreign Application Priority Data

Dec. 5, 1975 [DE] Fed. Rep. of Germany ..... 2554710
Oct. 25, 1976 [DE] Fed. Rep. of Germany ..... 2648158

[51] Int. Cl.[2] ..... E01C 23/14
[52] U.S. Cl. ..... 404/95; 404/90
[58] Field of Search ..... 404/90, 91, 77, 92, 404/95, 105, 101, 108, 93

[56] References Cited

U.S. PATENT DOCUMENTS

| | | | |
|---|---|---|---|
| 2,053,709 | 9/1936 | Flynn | 404/90 X |
| 2,093,766 | 9/1937 | Rich | 404/90 |
| 2,181,320 | 11/1939 | Flynn | 404/92 |
| 2,211,262 | 8/1940 | Flynn | 404/91 |
| 2,254,463 | 9/1941 | Wells | 404/95 |
| 2,705,906 | 4/1955 | Fizzell | 404/95 |
| 3,055,280 | 9/1962 | Neville | 404/95 |
| 3,361,042 | 6/1968 | Cutler | 404/90 X |
| 3,396,644 | 8/1968 | Banks | 404/108 X |
| 3,907,450 | 9/1975 | Cutler | 404/90 |
| 3,970,404 | 7/1976 | Benedetti | 404/77 |
| 3,970,405 | 7/1976 | Swisher | 404/105 |
| 4,018,540 | 4/1977 | Jackson | 404/95 |

*Primary Examiner*—Nile C. Byers, Jr.
*Attorney, Agent, or Firm*—W. G. Fasse; W. W. Roberts

[57] ABSTRACT

In a method and apparatus for resurfacing a road, the road surface is first plastified and broken-up by first and second separable devices. The broken-up material is immediately distributed on the road surface by the second device, whereby the broken-up material is simultaneously rearranged and profiled or contoured without the introduction of fresh asphalt or bituminous material at this point of time. A road surfacing or repaver apparatus forming a third separate device then introduces fresh asphalt or bituminous material to the broken-up distributed, rearranged and profiled top surface of the road. Preferably, two distributions of the broken-up material are employed prior to the asphalt application and compaction of the broken-up and distributed material and the new asphalt material. A truck supplies fresh asphalt or bituminous material to the repaver.

8 Claims, 6 Drawing Figures

METHOD AND APPARATUS FOR PLASTIFYING AND TEARING UP OF DAMAGED ROAD-SURFACES AND COVERS

BACKGROUND OF THE INVENTION

The invention relates to a method and apparatus for plastifying and tearing up damaged road-surfaces and covers, distributing and profiling the broken-up material, combining and laying of the broken-up material with fresh bituminous mixture, and the final profiling and condensing of the two layers.

Such equipment, which has become known under the name of "REPAVER", was for the first time put into service in Germany in the district of the Autobohnamt Darmstadt and made known to the public by the Hessian Television in its evening show called "HESSENSCHAU" early in November 1975.

This repaver-equipment combines, in one mobile unit, a vertically adjustable breaker. Mounted in front and behind the breaker are heaters to plastify the road-top coat and to further temper the breaking-up or broken-up material. The unit also has a single-distribution worm and, mounted thereafter, a vertical dressing beam. A unit comprising a distribution worm and a vibration beam is mounted on the end of the bearing frame.

This unit picks up the mixture at its front in the direction of motion, carries it over its entire length, and directly feeds it into the paving unit, i.e., between the distribution worm and the vibration beam.

This procedure and the equipment necessary for performing this procedure have the following disadvantages: (a) The combination of the mentioned units, i.e., a breaker, 2 heating units, a coarse distribution, including a worm and a dresser beam for the loosened material and a paving unit, not only have a high structural weight — and resulting therefrom, the necessity of power sources with high output — but they define and finally limit the utility of the machine, which is dependent on the ground and underground conditions, or its working depth, since the power requirements for the actual breaking-up work in relation to the entire power requirements is significant.

The limitation of the surface removed to about 1.5cm at the most, as observed when working on federal highways, is in many cases not sufficient, to fully remedy dents, truck grooves, or other damages, so that only a removal of the ridges takes place. For the road builder this means that the new road cover is badly anchored to the incompletely roughened or broken-up under layers.

Due to the combination of the individual groupings into one mobile unit, this unit is very long so that it is impossible to work in small curve radii. Thus, the employment of the procedure is essentially limited to the repair or renewal of federal highways or similar major roads. (b) The limitation of the breaking-up depth to about 1.5cm, i.e., to the removal of the ridges only, does not provide a sufficient quantity of torn-up surface material for subsequent repaving (80 - 120 kg/m$^2$). It has been observed that the total fresh-mixture output of the units is limited to about 50 kg/m$^2$ due to the given total power of the apparatus. Hence, the repaving takes place only to an insufficient thickness, and an insufficient inner binding results as well as a low quality bonding to the underground. (c) The placing of a second heating unit immediately behind the breaking-up tool leads often to inflaming of the broken-up surface, or to their permanent burning - since heat is generated by the breaking-up procedure due to the burning out of the low boiling hydrocarbon components of the binder material, whereby the latter loses its gluing capacity for further bonding with the same material or with fresh mixtures or the readiness to bond is at least considerably reduced. (d) The machine is not suited to repave roads in developed housing areas, since the large number of road caps, for example, for water, gas, and telephone services, etc., requires the raising of the entire machine, since the individual elevations cannot be detoured nor can they be removed manually under the long mobile unit. (e) The pre-distribution of the broken-up mixture over the width and the laying of the broken-up material by the mentioned auxiliary means - worm and rake - is not sufficient for a compensation between the areas of an increased and those of a decreased removal, so that the material fed into the paving unit is unequal in its thickness as well as in its consistency, whereby the long way over the entire machine and the cooling off of the mixture connected therewith has to be regarded as a further disadvantage for a satisfactory repaving.

(f) The tires of the heavy unit run on the broken-up and heated asphalt thereby producing in their track a considerable pre-compaction of the loosened material as well as a different structure of the surface, which should actually be uniform in every respect for the fresh bituminous material.

The above method is known as the "repave"-procedure.

Procedures of similar type, i.e., the "peeling-off" and "milling-off" procedures are also known.

The old surface material is removed by milling or peeling off procedures for secondary purposes. The peeled or milled-off material has to be heated up after it has been crushed first according to the requirements and normally a softener and/or a small quantity of binding material of high penetration is added.

The disadvantages and deficiencies of the procedures described are so aggravating that one can regard these procedures only as interesting research-tests and not, however, as real instructions for the regeneration of bituminous road surfaces.

OBJECTS OF THE INVENTION

It is therefore the object of this invention to provide a method and apparatus that enables a removal thickness, which includes also excessive deep areas in the damaged surface, as well as an equal distribution of the broken up material over the entire working width. The present apparatus and method are independent of the different material quantities resulting from varying removal thicknesses. The present method and apparatus permit; a considerably reduced pre-compacting of the regained material which is combined with a sufficient quantity of a fresh-bituminous mixture.

The equipment provided for practising the procedure is designed in regard to its weight and length in separate or separable units so that the present method and apparatus may be employed for roads of minor importance — for instance - for repaving municipal or county and secondary roads, etc.

SUMMARY OF THE INVENTION

The method according to the invention, is designed in such a way that the plastified material, immediately after it has been broken up, is rearranged and at the same time distributed on the road bed. In at least one of the following procedure steps it is redistributed and finally it is profiled or contoured as broken-up base pavement, and the fresh asphalt mixture is laid by a separate mobile unit onto this contoured or profiled broken-up base pavement, whereby it is profiled or contoured and consolidated by said separate mobile unit together with the broken-up base pavement.

Using an independently mobile unit for laying the fresh asphalt mixture onto a profiled broken-up base pavement not only enables a relatively small paving radius, but also reduces the individual weight of each independently movable equipment group in such a manner, that the extent of the pre-compacting of the broken-up base pavement by the independent mobile unit for laying the fresh mixture and for the common compacting and profiling or contouring together with the broken-up base pavement, is in no way detrimental to the procedure. Consequently, this mobile unit can be, in addition, a carrier of means by which track-grooves, etc., can be removed by breaking-up the surface.

The performing of the individual steps of the method with several independent mobile units enables the method to be employed in repaving roads with practically all possible curve radii.

By rearranging the broken-up material immediately after its production, one presents the broken-up parts from sticking together too strongly which would be disadvantageous in further handling. Distribution of the material is thus further facilitated. The broken-up material is guided and distributed by a series of scarifiers or similar means placed across the road that at the same time interchange the location of the material.

When the material runs through the scarifiers, the latter turns the material over in a manner similar to a ploughblade which causes, when they are mounted in several rows, a wriggling movement of the broken-up material in overlapping tracks.

A further distribution and final profiling or contouring of the broken-up material immediately after the distribution by the scarifiers, is accomplished by two overlapping and staggered worms moving back and forth over the entire working width. Each worm covers slightly more than half the working width and is reversible and adjustable in its speed.

To carry out this material distributing step of the method, the apparatus may be provided with a cross distribution, instead of the worms, so that the material, after it has been distributed by the staggered scarifiers, is moved back and forth over the working width at a blunt angle running positively or negatively to the work advance direction. The cross-distributor - thus cooperates with the advance of the breaking up unit. The speed and the direction-reversing of the cross-distributor is likewise variable in each direction.

In some cases a procedure is preferred in which the material is first moved by the worms and thereafter by a cross-distributor. It is also advantageous to equalize the material by a screeding bar or similar means after it has been moved for its distribution.

To practice the method, an equipment combination comprising three mobile, separate or separable units has been provided, including:

(a) one mobile unit to plastify the road surface, break it up and profile or contour the broken-up material anew, (b) one unit of known design, such as a truck, for adding fresh mixtures, and (c) one road-paver for the distribution of the fresh mixture onto the repaved broken-up material and for combining and compacting these two layers together.

Due to the separation of the breaking-up unit and the paving unit, according to this invention, and due to the use of separate drives for the two units, the breaking-up unit with its auxiliary equipment can be mounted on a short-chassis whereby the working or breaking-up depth may be adjustable and the adjusted depths may be fixed.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
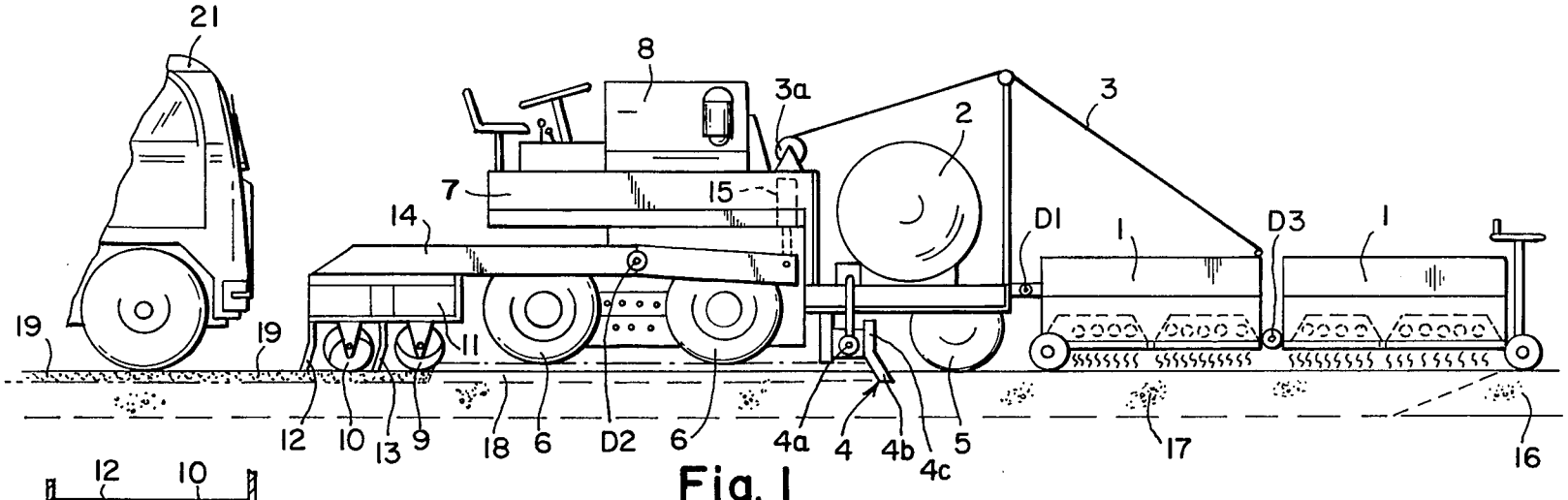
FIG. 1 is a simplified side view of the front portion of a three unit road resurfacing equipment in accordance with the invention, including the breaking-up equipment, as well as a part of the cabin of the following truck.
Figure 2:
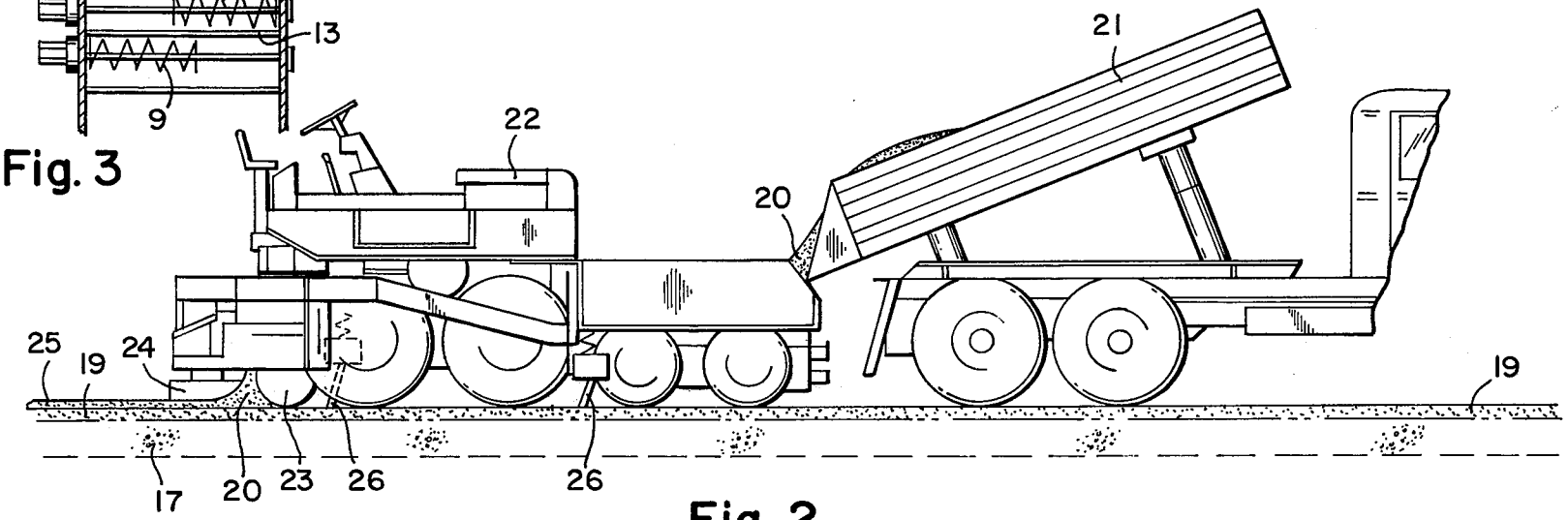
FIG. 2 is the rear continuation of the equipment of FIG. 1, including the rear portion of the truck as well as the paver-finisher.

The first part of the main mobile unit is a heating unit 1 which is flexibly linked at horizontal pivot D 1 to the mobile frame 7 of the breaker unit. The center of heating unit 1 is tiltable around horizontal pivot D 3 so that it is substantially adaptable to the longitudinal contour of the road surface by the use of the pulling device 3, i.e., a lifting cable or the like. The cantilever arms of the front steering axle 5 as well as the tearing-up beam 4 are attached to the main frame 7. The tearing or breaking-up beam 4 is provided in two parts for the purpose of contouring or profiling the road surface in a direction extending across the longitudinal direction. The beam 4 has a lower portion 4*b* inclined forwardly and downwardly and joined to a vertical upper portion 4*c*. The tearing-up beam 4 is adjustable in a height adjusting guide 4*a* of conventional construction. The front area of the frame 7 supports the heating gas tank 2 and also guides the rollers 3*a* of the pulling device 3. The pulling device 3 may be pulled by any conventional means, under the control of an operator.

Figure 3:
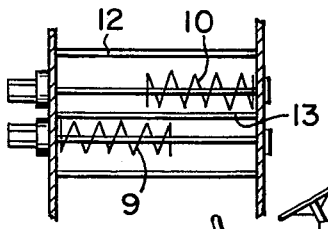
FIG. 3 is a simplified top view of one form of a distributor including worm blades in accordance with the invention, for use on the apparatus of FIG. 1, and including screeding and accumulation blades.

The driving and controlling units 8 are in the upper area of the frame 7. This part of the frame also supports the driving wheels 6, and the height adjustment device 15 for the bearing frame 14 of the pre-distributor means 9 to 13. The predistributor means 9 to 13 comprises the two semi-worm blades 9 and 10, the worm frame 11 and the screeding and accumulation blades 12 and 13 (see FIG. 3). The support frame 14 is pivotally mounted at the horizontal pivot D 2 with its cantilever arms pointing in the driving direction from left to right. The forward end of the frame is connected to a height adjustment device 15.

The driving and controlling means 8 are a combination of a combustion motor with hydraulic and/or mechanical drives, whereby the semi-worm blades 9 and 10 are driven by separate variable revolution speed and reversible hydraulic motors. The control-valve (not shown) for the driving motors of the worms is a continuously (stepless) adjustable and reversible multiway-valve of known construction.

The required change in revolution direction and of the speed is effected via a conventional lever (not shown).

In operation, the heating unit 1 heats the old bituminous top coat 16 and plastifies it, whereby the effective plastification extends to a depth 17 as indicated by the dashed line in FIG. 1.

The separation line fixed by the vertical infeed of the breaker beam 4 marks the start of the torn-up pavement surface 18, which is converted by the unit 9 to 13 into a flat surface of grain type structure, whereby the layer thus produced has a loose consistency.

The additionally required fresh bituminous mixture 20 to be spread over the area 19 is next brought to the feeding-trough of a finisher 22 by a rear-dumper 21 and then equally distributed over the area 19 by the usual distribution worm of the layer unit 23 and then "drawn" under the vibration beam 24. The vibration beam 24 guides the still warm broken-up material. The temperature of this material is still higher than the softening temperature of the binder material. The beam 24 combines the broken-up material with the freshly fed hot-mixture 20. The materials thereby enter into an intimate bond with each other and compact themselves to form a uniform, homogeneously bonded layer 25.

The pre-compacting due to feeding the new material and due to the tires of the finisher must be compensated before both the materials are combined. For this purpose, there are secured to the chassis of the finisher, scarifiers such as steel rakes 26 which are adjustable in height and which, according to the individual requirements, may be caused to penetrate into the area 19.

Figure 4:
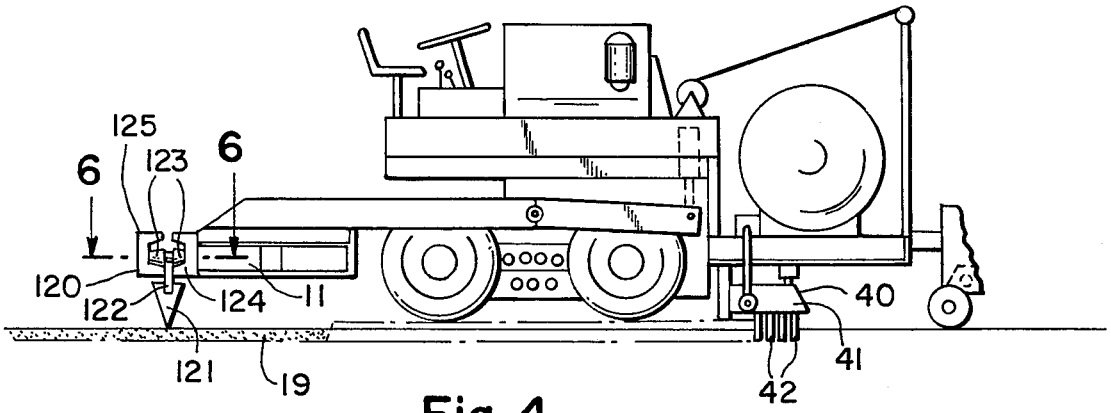
FIG. 4 is a simplified side view of a modification of the breaking-up point of FIG. 1, employing different forms of road surface breaking-up equipment and a reciprocating distributor instead of the screeding blades and worm blades of FIG. 3.
Figure 5:
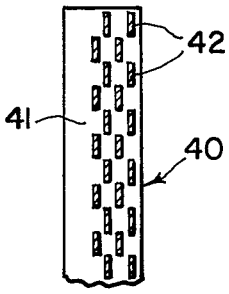
FIG. 5 is a cross-sectional view of a portion of the apparatus of FIG. 4, taken in a horizontal plane extending through the teeth 42 of the breaking-up apparatus.

FIGS. 4 and 5 show a modified breaker unit 40. The essential parts of the breaker unit 40 is fixedly mounted on the carrier beam 41. The beam 41 is adjustable in height. The unit 40 carries the downwardly extending breaker teeth 42. The teeth 42 are mounted in four transverse rows, with the teeth of each row being behind the gap between the teeth of the preceeding row. As a result, the broken-up material is forced to run through the rows, transversely of the feed advance direction, in a wiggling movement. The material is thus equalized in regard to the grain size. Simultaneously a pre-distribution across the broken-up width of the road surface is accomplished.

Figure 6:
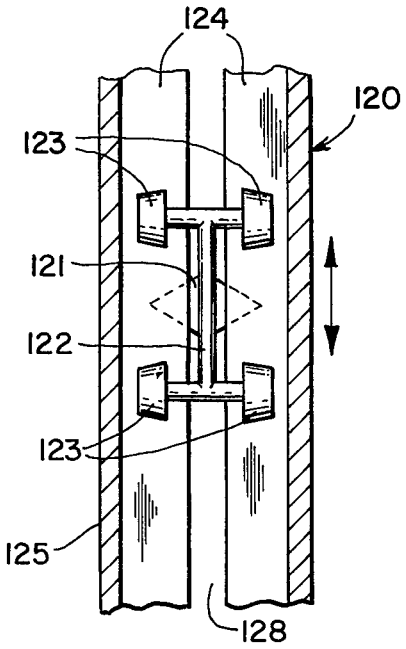
FIG. 6 is a partially cross-sectional view of the apparatus of FIG. 4, taken along the lines 6 — 6, and showing the cross distributors.

In FIGS. 4 and 6, a cross-distributor 120 is used to produce a uniform area 19, i.e., a pre-laying of the broken-up material. The embodiment of FIGS. 4 and 6 may be used instead of the screeding blades and the accumulation blades as well as the worm blades of FIGS. 1 and 3.

The distribution element or blade 121 is mounted on a hanger 122 suspended on four rollers 123. The rollers 123 are rollable in two horizontal U-profiled beams 124, the open sides of which face each other and are separated by a gap 128, the hanger 122 extending downwardly through the gap. The U-profiled beams are connected to each other by suitable means and form the bearer 125 for the distribution element 121.

The bearer 125 is horizontally affixed to the frame 11. The distribution element 121 may be moved in both directions, corresponding to the double-arrow by suitable conventional means (not shown in the drawing).

The operating power required for the mobile unit according to the invention is solely dependent on the power requirements of the breaker at maximum breaking-up depth, whereby the optimal feed advance speed as well as the power requirements for the distribution of the broken-up material are to be taken into account. In some cases, according to the particular equipment combination, the necessary power requirements to activate the heating means may be considered when calculating the power output of the main drive unit.

Thus, for the present combination one need not consider the requirements for the paving unit, i.e., the finisher as well as the power requirements for transporting the mixed material the entire length of the machine, as was necessary with the repaver. Thus, the invention may easily provide excess power enabling the working depths to extend to the required 4 to 5 cm. In addition, the scraping or breaking-up of the old surface over the entire working width may be done in one operation. The repaving can also be effected with a sufficient quantity of broken-up material, which can be distributed equally over the laying width by the system of the invention, e.g., by the worms, mounted in staggered and overlapping relationships. Besides, depending on individual requirements these worm blades 9, 10 may be driven in different directions and with different speeds.

It has already been pointed out that the present method and equipment has excellent curve working characteristics.

Naturally, compaction by the tires of the truck cannot always be sufficiently prevented, when bringing in the freshly mixed bituminous material by the usual rear-dumper trucks over the length of the distance between breaker and finisher for filling the finisher trough. These compactions caused by the truck tires as well as the compaction caused by the finisher are removed by means mounted to the chassis of the finisher, so that, when laying the fresh mixture, there will be a surface of even and uniform consistency to form a good foundation for the bonding and compacting of two road surface layers.

The main frame of the mobile unit, for plastifying, breaking-up and profiling the broken-up material, supports the two-part break-up beam as well as the steering axle by a rigid cantilever beam.

Furthermore, said cantilver beam of the main frame is pivoted to the heating unit in front of the breaker. The frame for the worm and/or the cross distributor, as well as the accumulation blades, is movably and adjustably fixed at its swivel point to said main frame.

The heating unit for plastifying the road surface material is for practical reasons divided in its length and the individual parts are movably linked together at a pivot. Pulling equipment on the frame is connected to the part of the heating unit connected to the main frame in order to pivot the heating unit at this pivot.

The combination of the mobile unit for the plastifying, breaking-up and profiling or contouring anew of the broken-up material, with a flexibly mounted heating unit and with the cross distributor to form a relatively short operational unit constitutes a characteristic feature of the invention. This arrangement enables the equipment to run through curves of the smallest radius, and furthermore, permits avoidance of renewed heating immediately after the breaking-up process behind the breaking-up beam.

The provision of a two-part breaking-up beam facilitates the profiling, and for instance, permits the production of crowned contours.

Due to the partition of the heating unit, it is possible to adapt the unit to longitudinally extending ridges and depths so that the surface is practically exposed to an equal heat.

Finally, as above stated, the method and the three-part equipment combination enables a sufficient breaking-up depth and permits a further utilization of the material without negative effects on the material. The combination also has a wider operational range due to its better curve characteristics.

Although the invention has been described with reference to specific example embodiments, it is to be understood that it is intended to cover all modifications and equivalents within the scope of the appended claims.

What is claimed is:

1. An apparatus for resurfacing a road including a mobile apparatus for breaking up a road surface and distributing a layer of broken-up material on said road surface, said mobile apparatus comprising a main frame having a forwardly extending cantilever arm, a heating unit pivotally mounted to the front end of said cantilever arm, road surface breaking-up means adjustably mounted to said cantilever arm, and steering means further mounted on said cantilever arm, said apparatus further comprising broken-up material distributing means, and means pivotally mounting said distributing means to said main frame behind said breaking-up means, and means for adjusting the position of said distributing means, said broken-up material distributing means comprising means for rearranging and distributing broken-up material from said breaking-up means on a road surface.

2. The apparatus of claim 1, wherein said heating unit comprises a plurality of separate heating means pivotally mounted together along the length of said heating unit, whereby the rearmost of said heating means is pivotally affixed to said cantilever arm, and further comprising pulling means attached to said rearmost heating means, and means on said main frame for pulling said pulling means to rotate said rearmost heating means at the pivotal interconnection with said cantilever arm.

3. The apparatus of claim 1, wherein said breaking up means comprises a breaking up beam.

4. The apparatus of claim 1, wherein said breaking up means comprises a plurality of transverse rows of downwardly extending teeth adapted to be drawn lengthwise in a road surface for breaking up said road surface, the teeth of each row being behind the gaps of the teeth of the next forward row of teeth, for predistributing and rearranging broken-up road material on a road surface.

5. The apparatus of claim 1, wherein said distributing means comprises a pair of worms mounted for rotation about parallel spaced apart horizontal axes, each said worm having a length substantially equal to half the working width of said apparatus, with said worms being staggered, and means for rotating said worms.

6. The apparatus of claim 1, wherein said distributing means comprises a distributing blade, and means for moving said distributing blade to and fro across a road surface behind said breaking up means.

7. The apparatus of claim 1, further comprising a second separate mobile unit including means for plastifying a road surface prior to breaking up said road surface, wherein said broken-up material distributing means are adapted for profiling the broken-up material on said road surface, and a third separate mobile unit comprising road paving means for distributing fresh asphalt material onto a broken-up layer base on said road surface and for compacting said broken-up material and fresh asphalt mixture, and means pivotally mounting said first and second units together, said apparatus further comprising a fourth mobile unit including means for supplying freshly mixed asphalt material to said third mobile unit.

8. The apparatus of claim 7, wherein said third mobile unit comprises means for loosening broken-up materials on said road surface prior to applying said asphalt material thereto.

* * * * *